US009938986B2

(12) United States Patent
Fujimoto et al.

(10) Patent No.: US 9,938,986 B2
(45) Date of Patent: Apr. 10, 2018

(54) CENTRIFUGAL FAN

(71) Applicants: MINEBEA CO., LTD., Kitasaku-gun, Nagano (JP); TOYOTA BOSHOKU KABUSHIKI KAISHA, Kariya-shi, Aichi-ken (JP)

(72) Inventors: Seiya Fujimoto, Fukuroi (JP); Hitoshi Ikuta, Fukuroi (JP); Atsushi Tsuzaki, Toyota (JP); Yuya Inoue, Gifu (JP); Yumi Asano, Seto (JP)

(73) Assignees: Minebea Co., Ltd., Nagano (JP); Toyota Boshoku Kabushiki Kaisha, Aichi-ken (JP)

( * ) Notice: Subject to any disclaimer, the term of this patent is extended or adjusted under 35 U.S.C. 154(b) by 307 days.

(21) Appl. No.: 14/807,272

(22) Filed: Jul. 23, 2015

(65) Prior Publication Data

US 2016/0025103 A1 Jan. 28, 2016

(30) Foreign Application Priority Data

Jul. 25, 2014 (JP) ..... 2014-152396

(51) Int. Cl.
*F04D 29/42* (2006.01)
*F04D 17/08* (2006.01)
(Continued)

(52) U.S. Cl.
CPC ..... *F04D 29/4226* (2013.01); *F04D 17/08* (2013.01); *F04D 17/16* (2013.01);
(Continued)

(58) Field of Classification Search
CPC ..... F04D 17/08; F04D 29/4226; F04D 17/16; F04D 25/0613; F04D 29/281;
(Continued)

(56) References Cited

U.S. PATENT DOCUMENTS 5,352,089 A * 10/1994 Tokunaga ..... B60H 1/00471 415/119
7,179,050 B2 2/2007 Hopfensperger
(Continued)

FOREIGN PATENT DOCUMENTS

CN 200958493 Y 10/2007
CN 202381399 U 8/2012
(Continued)

OTHER PUBLICATIONS

Office Action dated Jun. 17, 2016 in the corresponding German Patent Application No. 102015009591.9 with English translation.
(Continued)

*Primary Examiner* — Woody Lee, Jr.
*Assistant Examiner* — Sang K Kim
(74) *Attorney, Agent, or Firm* — Carrier Blackman & Associates, P.C.; Joseph P. Carrier; Jeffrey T. Gedeon

(57) ABSTRACT

A centrifugal fan includes: an impeller; an upper casing that is disposed above the impeller; a lower casing that is disposed below the impeller; an outlet port that is provided between the upper casing and the lower casing and from which an air suctioned by rotation of the impeller is discharged, wherein the upper casing is provided with a flange that protrudes in an outer radial direction of the impeller from an outer circumferential edge of the upper casing, and wherein the flange partially covers the outlet port when viewed from a direction perpendicular to a rotation axis of the impeller.

10 Claims, 6 Drawing Sheets

(51) Int. Cl.

| | |
|---|---|
| ***F04D 29/28*** | (2006.01) |
| ***F04D 17/16*** | (2006.01) |
| ***F04D 25/06*** | (2006.01) |
| ***F04D 29/70*** | (2006.01) |

(52) U.S. Cl.
CPC ..... *F04D 25/0613* (2013.01); *F04D 29/281* (2013.01); *F04D 29/703* (2013.01); *F05D 2250/52* (2013.01)

(58) Field of Classification Search
CPC ..... F04D 29/703; F04D 29/4233; F04D 29/4246; F04D 29/4206; F05D 2250/52
See application file for complete search history.

(56) References Cited

U.S. PATENT DOCUMENTS

2009/0060730 A1* 3/2009 Hwang ..... F04D 29/281 415/203
2012/0134795 A1 5/2012 Fukuda et al.
2014/0010682 A1 1/2014 Suzuki et al.
2014/0044534 A1 2/2014 Yamasaki et al.
2014/0356131 A1* 12/2014 Park ..... F04D 29/162 415/113
2015/0173577 A1* 6/2015 Kim ..... A47L 9/22 15/412
2016/0264028 A1* 9/2016 Kawashima ..... F04D 25/0613

FOREIGN PATENT DOCUMENTS

CN 102900704 A 1/2013
CN 203476796 U 3/2014
DE 10313054 A1 10/2004
JP 2014-015849 A 1/2014

OTHER PUBLICATIONS

Office Action dated Apr. 28, 2017 in the corresponding Chinese Patent Application 2015-10437106.2 with the English translation thereof.

* cited by examiner

FIG. 6

| | SIZE OF "L" | PRESENCE/ABSENCE OF FLANGE | NOISE (dB) | STATIC PRESSURE (Pa) at 40 CMH |
|---|---|---|---|---|
| COMPARATIVE EXAMPLE 1 | 6.5 mm | NO FLANGE | 59.8 | 264 |
| COMPARATIVE EXAMPLE 2 | 2.0 mm | WITH FLANGE (NO PROTRUDING STREAKS) | 60.8 | 218 |
| EMBODIMENT | 4.5 mm | WITH FLANGE (WITH PROTRUDING STREAKS) | 59.3 | 256 |

CENTRIFUGAL FAN

BACKGROUND OF THE INVENTION

1. Field of the Present Invention

The present invention relates to a centrifugal fan and, more particularly, to a centrifugal fan that discharges air outward from an outlet port formed between an upper casing and a lower casing with rotation of an impeller.

2. Description of the Related Art

A centrifugal fan is widely used for cooling, ventilation, air conditioning, and the like in a variety of equipment such as household electrical appliances, office automation equipment, and industrial equipment, or for a fan installed in vehicles.

JP-A-2014-015849 discloses a configuration of a centrifugal fan in which an impeller is accommodated between an upper casing and a lower casing. Such a centrifugal fan is configured to discharge air suctioned from an inlet port outward from an outlet port formed between the upper casing and the lower casing with rotation of the impeller. The outlet port of air is formed in four side faces of a casing having a rectangular parallelepiped shape.

In a centrifugal fan having the structure described in JP-2014-015849, the impeller is located immediately behind the outlet port. Accordingly, a wide range of the outlet port of the centrifugal fan may be exposed outside when viewed from the outside depending on the how the centrifugal fan is attached or installed in an equipment. In the state in which a wide range of the outlet port is exposed in this way, foreign object such as another member or a user's finger approaches the centrifugal fan, there is a possibility that the foreign object might come into contact with the impeller. When another member or the like comes into contact with the impeller, the impeller may not keep rotating smoothly.

SUMMARY

One of objects of the present invention is to provide a centrifugal fan having a low possibility that rotation of an impeller will be hindered.

According to an illustrative embodiment of the present invention, there is provided a centrifugal fan including: an impeller; an upper casing that is disposed above the impeller; a lower casing that is disposed below the impeller; an outlet port that is provided between the upper casing and the lower casing and from which an air suctioned by rotation of the impeller is discharged, wherein the upper casing is provided with a flange that protrudes in an outer radial direction of the impeller from an outer circumferential edge of the upper casing, and wherein the flange partially covers the outlet port when viewed from a direction perpendicular to a rotation axis of the impeller.

BRIEF DESCRIPTION OF THE DRAWINGS

In the accompanying drawings:

FIG. 6 is a table illustrating a relationship between presence and absence of a flange and characteristics of a centrifugal fan.

DETAILED DESCRIPTION

Hereinafter, a centrifugal fan according to an embodiment of the invention will be described.

Figure 1:
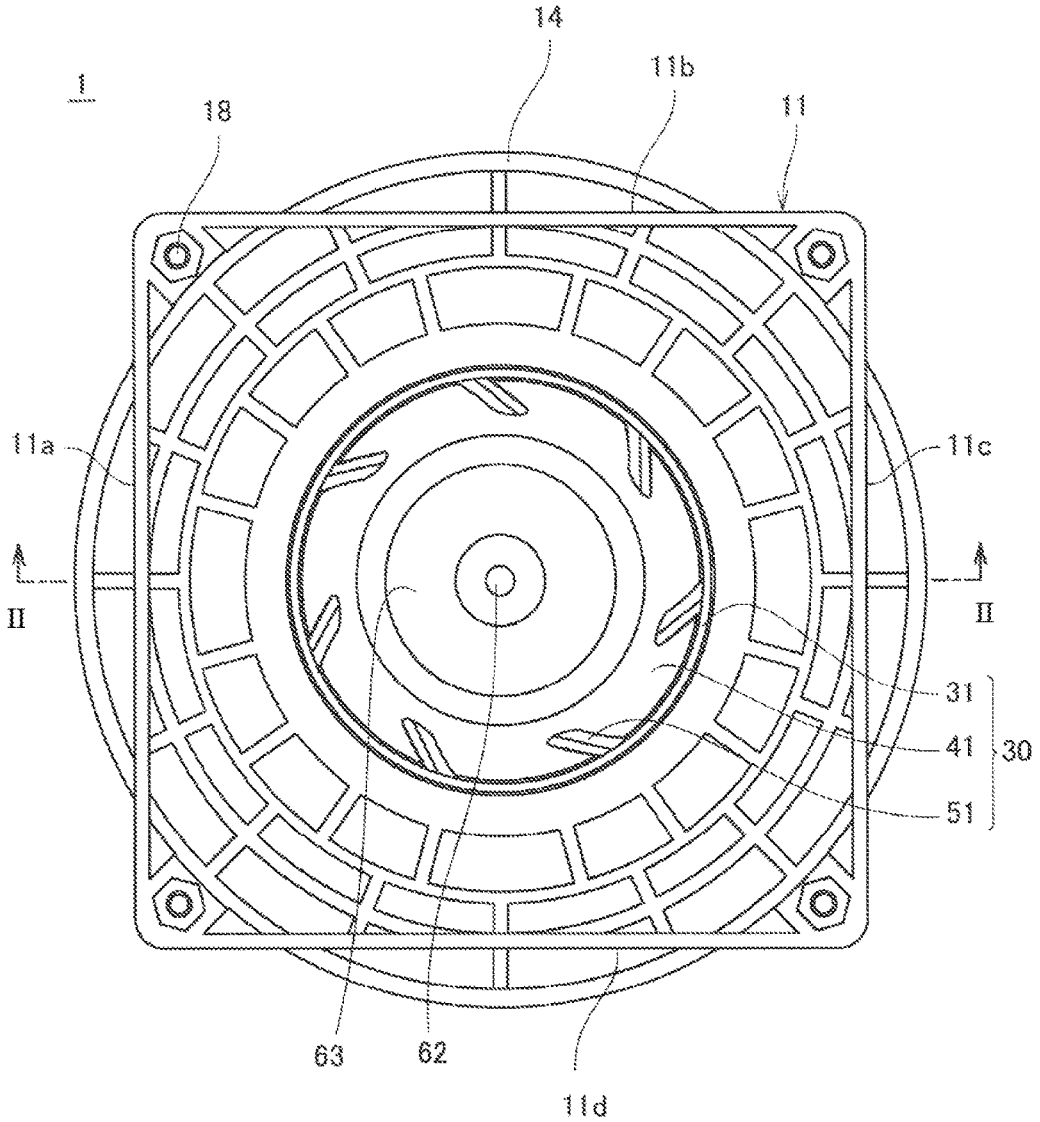
FIG. 1 is a plan view illustrating a centrifugal fan according to an embodiment of the invention.
Figure 2:
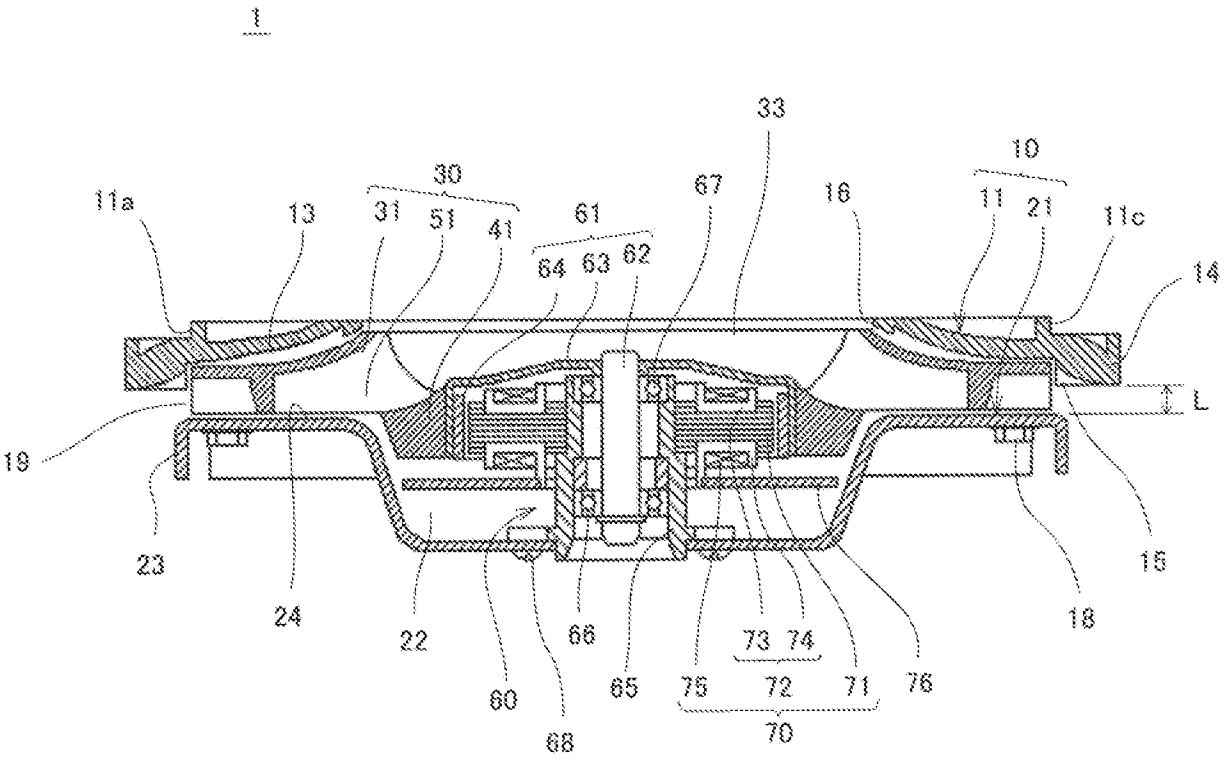
FIG. 2 is a cross-sectional view taken along line II-II shown in FIG. 1.

FIG. 1 is a plan view illustrating a centrifugal fan according to an embodiment of the invention. FIG. 2 is a cross-sectional view taken along line II-II shown in FIG. 1.

Referring to FIGS. 1 and 2, a centrifugal fan 1 is provided with a casing 10, an impeller 30, and a motor 60. The centrifugal fan 1 has a rectangular parallelepiped shape having a substantially square shape in a plan view as a whole, except for a flange 14 which will be described later. The centrifugal fan 1 is configured to have small height in which the size in the vertical direction (height) is relatively small.

The impeller 30 is attached to a rotor 61 which rotates along with a shaft 62 of the motor 60. The centrifugal fan 1 rotates the impeller 30 using the motor 60. The centrifugal fan 1 discharges air suctioned from an inlet port 33 to a lateral side of the impeller 30 with the rotation of the impeller 30. That is, air suctioned from the inlet port 33 passes between blades 51 of the impeller 30 and is discharged outward from an outer circumferential portion of the impeller 30, by a hydrodynamic force resulting from a centrifugal action accompanying with the rotation of the impeller 30. The air is discharged outward from outlet ports 19 which are formed on four side faces of the casing 10.

The motor 60 is, for example, an outer rotor type brushless motor. The motor 60 is attached to the bottom surface of a recessed portion 22 at the center of the lower casing 21 using a fastening member 68 such as a screw or a bolt. A rotor 61 includes a cup-like rotor yoke 63 which is opened downward, an annular magnet 64 which is attached on the inner circumferential surface of the rotor yoke 63, and a shaft 62 which is attached to the center of the rotor yoke 63.

The shaft 62 is rotatably supported by a pair of bearings 66 and 67 attached to a bearing holder 65. A stator 70 is formed on the outer circumferential portion of the bearing holder 65.

The stator 70 includes a stator core 71, an insulator 72, and a coil 75. The stator core 71 is formed by stacking plural cores. The insulator 72 has a configuration in which an upper insulator 73 and a lower insulator 74 are attached from both sides of the stator core 71 in a rotation axis direction (hereinafter, also simply referred to as an axial direction) of the impeller 30. The coil 75 is wound on the stator core 71 with the insulator 72 interposed therebetween. The stator core 71 is attached to the outer circumference of the bearing holder 65 and is disposed to face the magnet 64 with a predetermined gap in a radial direction (the left-right direction in FIG. 2). A circuit board 76 on which an electronic component for controlling the motor 60, a drive circuit, and the like are mounted is attached to the lower insulator 74. Winding ends of the coil 75 are electrically connected to the circuit board 76.

The impeller 30 is disposed to enter the casing 10. The impeller 30 has a disk shape as a whole. The impeller 30 includes an annular shroud 31, a hub 41, and plural blades 51 disposed between the annular shroud 31 and the hub 41. An inlet port 33 is formed at the center of the annular shroud 31. The hub 41 attached to the rotor 61 is disposed at the center of the impeller 30.

As illustrated in FIG. 1 the plural blades 51 are arranged regularly at predetermined intervals on a circumference. The blades 51 have the same curved shape and are backward-curved blades (so-called turbo blades) which are obliquely curved and inclined backward with respect to the rotation direction. Each blade 51 extends downward in the axial direction from the annular shroud 31 and a part on the inner circumference side of the blade 51 is coupled to the hub 41.

In the embodiment, the annular shroud 31, the hub 41, and the blades 51 are formed by integral molding, for example, using engineering plastic.

The casing 10 is configured by an upper casing 11 and a lower casing 21. The upper casing 11 is disposed above the impeller 30 and the lower casing 21 is disposed below the impeller 30. The upper casing 11 and the lower casing 21 are coupled to each other by causing fastening members 18 such as bolts to penetrate supports (not illustrated) disposed between the upper casing 11 and the lower casing 21 at four corners in a plan view. The supports are members other than the upper casing 11, but may be formed by integral molding with the upper casing 11. The casing 10 is not limited to the configuration in which the upper casing 11 and the lower casing 21 are coupled to each other using the fastening members 18 penetrating the supports. For example, the upper casing 11 and the lower casing 21 may be coupled to each other by tightly fastening tapping screws as the fastening members 18 to pilot holes formed in the supports, and the fastening means is not limited to these configurations.

The upper casing 11 is formed of, for example, a resin such as engineering plastic. An opening 16 is formed at the center of the upper casing 11. The opening. 16 has a circular shape in a plan view and air is introduced into the inlet port 33 of the impeller 30 from the opening 16.

Figure 4:
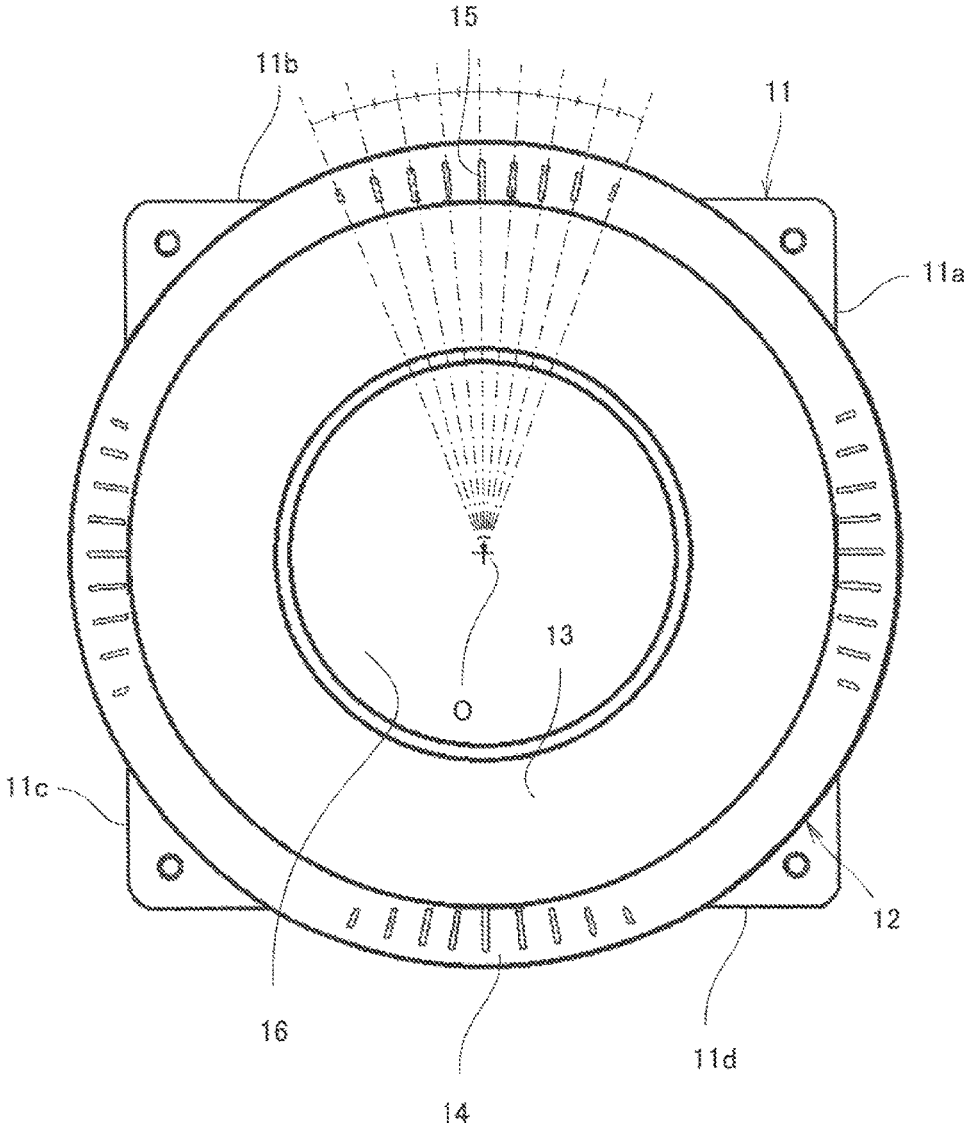
FIG. 4 is a bottom view illustrating the upper casing.

Plural small-thickness portions are formed on the top face side of the upper casing 11. A disk-like annular shroud accommodating portion 12 (which is illustrated in FIG. 4) is formed on the bottom surface side of the upper casing 11. A recessed portion 13 is formed to be concave upward in the annular shroud accommodating portion 12. The annular shroud 31 of the impeller 30 is tightly set and accommodated in the recessed portion 13. Accordingly, the outer diameter of the recessed portion 13 is greater than the outer diameter of the annular shroud 31 of the impeller 30.

In the embodiment, the annular shroud accommodating portion 12 is formed to protrude outward from four side portions 11*a*, 11*b*, 11*c*, and 11*d* of the body of the upper casing 11. Each of the four protruding portions is a flange 14 having an arch shape which is surrounded with an arc and a bowstring (the circumferential edge of the corresponding side portion 11*a*, 11*b*, 11*c*, and 11*d*) thereof in a plan view.

The lower casing 21 is formed of, for example, a metal sheet such as a steel sheet. A recessed portion 22 which is concave downward is formed at the center of the lower casing 21. The motor 60, the circuit board 76, and a part of the hub 41 of the impeller 30 are disposed in the recessed portion 22. The motor 60 is attached to the lower casing 21 by inserting one end of the bearing holder 65 into an opening formed in the bottom surface of the recessed portion 22 and tightly fastening the fastening members 68 such as bolts to the bearing holder 65. The motor 60 may be attached to the lower casing 21 by fixing the lower portion of the bearing holder 65 to the bottom surface of the recessed portion 22 by caulking instead of using the fastening members 68.

A side plate 23 which is bent in the axial direction is disposed in the outer circumferential portion of the lower casing 21. Since the side plate 23 is formed, the rigidity of the lower casing 21 is improved. The top face 24 of the lower casing 21 is flat and faces the bottom surfaces of the blades 51 with a predetermined gap therebetween. The top face 24 serves as a part of a flow channel for guiding air introduced from the inlet port 33 to the sides. The gap between the bottom surfaces of the blades 51 and the lower casing 21 is set to an appropriate value so as to improve air volume characteristics of the centrifugal fan 1 (an excessive gap affects the air volume characteristics). The material of the lower casing 21 is not limited to the metal sheet such as a steel sheet, and may be a resin material as long as it can secure flatness and rigidity of the top face 24.

In the centrifugal fan 1, areas between the upper casing 11 and the lower casing. 21 other than the fastened portions (support portions) of the upper casing 11 and the lower casing 21 in four side portions of the casing 10 serve as the outlet ports 19 of air.

Figure 3:
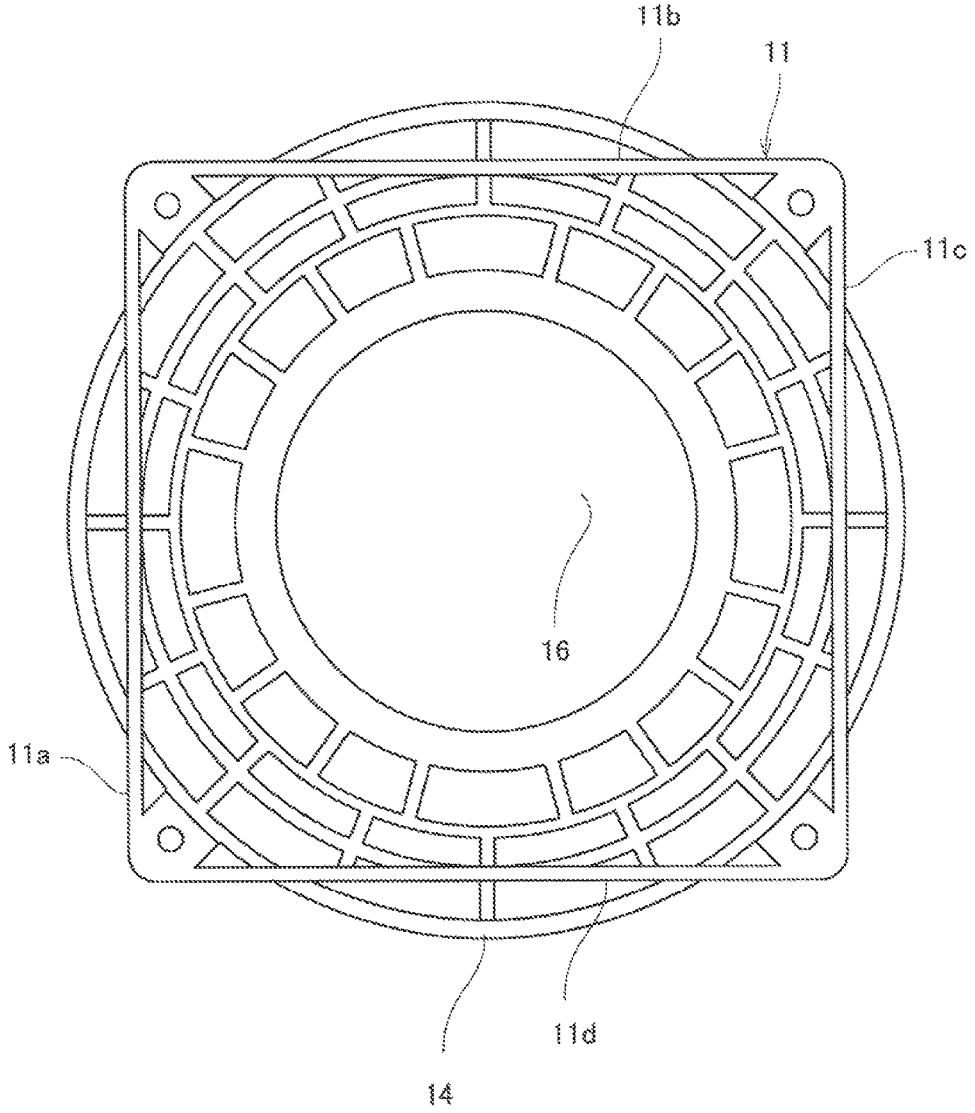
FIG. 3 is a plan view illustrating an upper casing.
Figure 5:
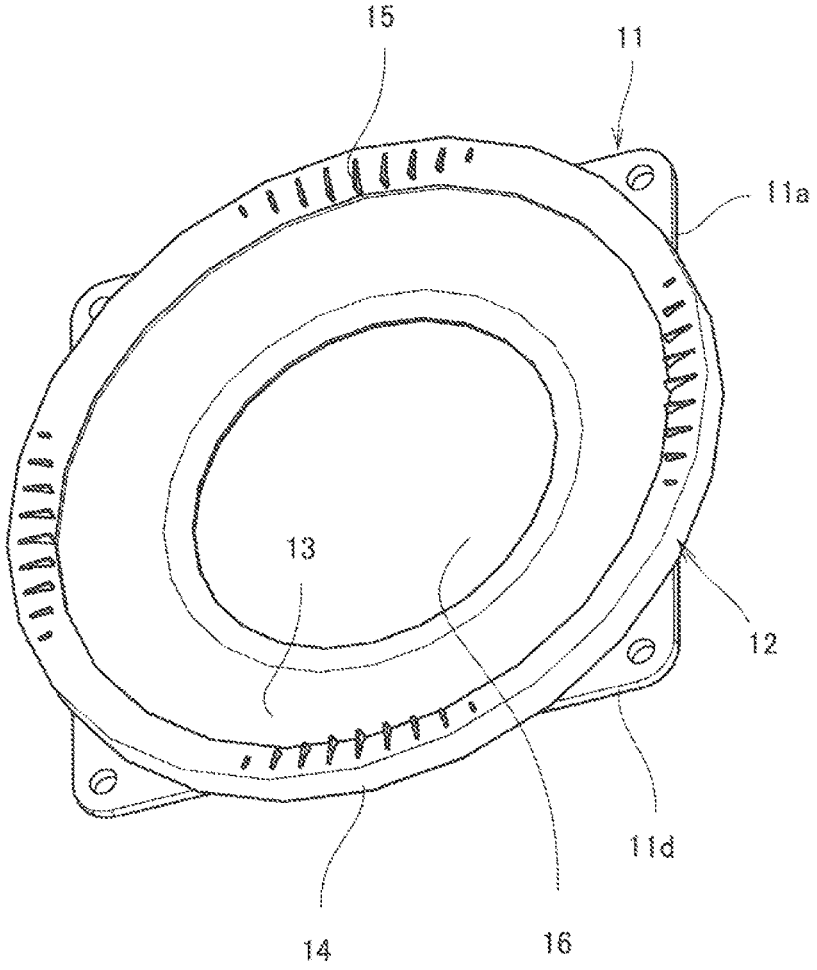
FIG. 5 is a perspective view illustrating a bottom surface side of the upper casing.

FIG. 3 is a plan view illustrating, the upper casing 11. FIG. 4 is a bottom view illustrating the upper casing 11. FIG. 5 is a perspective view illustrating a bottom surface side of the upper casing 11.

The shape and structure of the flange 14 of the upper casing 11 will be described below with reference to FIGS. 3, 4, and 5.

As illustrated in FIG. 3, in the embodiment, the flange 14 is a part of the annular shroud accommodating portion 12 protruding outward from four side portions 11*a*, 11*b*, 11*c*, and 11*d* of the body of the upper casing 11. Since the annular shroud accommodating portion 12 has a circular shape in a plan view and the upper casing 11 has a substantial square shape in a plan view, each of the four flanges 14 has an arched shape which is surrounded with a part of the circumferential portion of the annular shroud accommodating portion 12 and the circumferential portion of the corresponding side portion 11*a*, 11*b*, 11*c*, and 11*d* in a plan view. That is, the flanges 14 are formed in the outlet ports 19 of the centrifugal fan 1.

As illustrated in FIG. 4, plural protruding streaks 15 are formed on the surface on the bottom side (side facing the lower casing 21) of each flange 14. As illustrated in FIG. 5, each protruding streak 15 is a streaked (rib-shaped) member which protrudes downward in the axial direction from the surface of each flange 14.

The flanges 14 and the protruding streaks 15 are a part of the annular shroud accommodating portion 12 and are integrally formed with other parts of the upper casing 11 by injection molding using, a resin.

As illustrated in FIG. 2, each flange 14 has a predetermined size (thickness) in the axial direction and partially covers the corresponding outlet port 19. Since each flange 14 covers a part of the corresponding outlet port 19 in this way, the range of the corresponding outlet port 19 exposed from the side is narrower than that when it is assumed that the flanges 14 are not formed.

In the embodiment, specifically, about a half of the size in the axial direction (height) of each outlet port 19 is covered with the flange 14 when viewed from a direction perpendicular to the rotation axis of the impeller 30, that is, when viewed from a side of the centrifugal fan 1. However, since plural protruding streaks 15 are formed on the bottom surface of each flange 14, air passes between the protruding streaks 15 from the impeller 30 and is smoothly discharged outward. In other words, the heights or shapes of the flanges 14 and the protruding streaks 15 are set so as to smoothly discharge air to the outside of the casing 10 without being hindered.

As illustrated in FIG. 4, nine protruding streaks 15 are formed in each flange 14. In the embodiment, the protruding streaks 15 of each flange 14 are arranged such that angles formed by a straight line connecting one protruding streak to the center O of the upper casing and straight lines connecting the neighboring protruding streaks 15 to the center O of the upper casing 11 are equal to each other. The nine protruding streaks 15 are arranged to be symmetric with respect to a straight line passing through the center O and being perpendicular to the corresponding side portions 11*a*, 11*b*, 11*c*, and 11*d* in a bottom view as a whole. Particularly, in the embodiment, the nine protruding streaks 15 are arranged to be symmetric with respect to a straight line passing through the central protruding streak 15 and the center O in a bottom view.

In the embodiment, the lengths in the radial direction of the nine protruding streaks 15 are set such that the length of the central protruding streak 15 is the greatest and the lengths gradually decreases as it is spaced farther from the central protruding streak 15. In a plan view, each flange 14 has an arched shaped and the lengths of the flanges 14 protruding from four circumferential edges of the lower casing 21 (the length protruding in directions perpendicular to both sides surfaces of the casing 10) decrease as it approaches the corners (the corner of the lower casing 21 has a square shape) from the center of each circumferential edge. That is, the lengths in the radial direction of the nine protruding streaks 15 are set depending on the length of each flange 14 protruding from the outer circumferential edge of the lower casing 21 at the positions of the protruding streaks 15. More specifically; in a bottom view, the outer edges of the protruding streaks 15 are located at positions separated inward by a substantially constant distance from the outer circumferential edges of the corresponding flanges 14 and the inner edges of the protruding streaks 15 are located at positions which substantially overlap the four side portions 11*a*, 11*b*, 11*c*, and 11*d* of the body of the upper casing 11. Accordingly, the lengths in the radial direction of the nine protruding streaks 15 are set such that the length of the central protruding streak 15 is the greatest and the lengths decrease as it approaches both ends.

The centrifugal fan 1 has the above-mentioned configuration and thus operates as follows. That is, as illustrated in FIG. 2, since the outlet ports 19 formed between the upper casing 11 and the lower casing 21 also serves as a motor base are partially covered with the flanges 14 having a thickness, foreign object hardly approach the outlet ports 19. For example, even when a tool, a wire in equipment, a user's finger, or the like approaches the centrifugal fan 1 for a certain reason, the approaching is hindered by the flanges 14 protruding, sideward and the foreign object hardly approach the outlet ports 19. Since the flanges 14 cover a part of each outlet port 19, the foreign object are prevented from being inserted into the outlet ports 19. Accordingly, the possibility that the rotation of the impeller 30 will be hindered by the foreign object is greatly lowered and it is thus possible to smoothly rotate the impeller 30.

Since the protruding streaks 15 are formed in the flanges 14, it is possible to secure an air volume to be supplied from the centrifugal fan 1 while effectively preventing, the foreign object from invading the outlet ports 19. The positions and shapes of the protruding streaks 15 are designed as described above and air discharged from the outer circumference edge of the impeller 30 is rectified by the protruding streaks 15. Accordingly, it is possible to reduce noise generated when the centrifugal fan 1 is driven.

The flanges 14 and the protruding streaks 15 are formed by integral molding with the upper casing 11. Accordingly, it is possible to decrease the number of components of the centrifugal fan 1 and thus to reduce the manufacturing cost of the centrifugal fan 1.

Particularly, when a user's finger is considered as an example of the foreign object, it is preferable that the length in the axial direction (size L in FIG. 2) of a part in which each outlet port 19 is not covered with the corresponding flange 14 when viewed from a direction perpendicular to the rotation axis of the impeller 30 be less than 5.6 mm. That is, in general, a reference size of a finger of an infant under 36 months is 5.6 mm in diameter (according to a small finger probe defined in Japanese Industrial Standards: JIS C 0922). Accordingly, by setting the size L of the part of each outlet port 19 not covered to be less than 5.6 mm, it is possible to relatively satisfactorily prevent a finger of an infant under 36 months from being inserted into the outlet port and thus to lower the possibility that the rotation of the impeller 30 will be hindered.

FIG. 6 is a table illustrating a relationship between presence and absence of the flanges 14 and characteristics of the centrifugal fan 1.

In FIG. 6, the magnitude of noise (decibel) and the magnitude of a static pressure (Pa) when centrifugal fans are driven to obtain a predetermined flow rate are illustrated for a centrifugal fan having a configuration according to "Comparative Example 1", a centrifugal fan having a configuration according to "Comparative Example 2", and the centrifugal fan 1 according to "The embodiment." Here, a value when the flow rate is 40 CMH (Cubic Meter per Hour (m3/h)) is described as the static pressure (Pa).

"Comparative Example 1" provides a centrifugal fan not including the flanges 14. In "Comparative Example 1," the height of the outlet port 19 (size L in FIG. 2) is 6.5 mm.

"Comparative Example 2" provides a centrifugal fan including the flanges 14 but not including plural protruding streaks 15 in the flanges 14. In "Comparative Example 2," the height of the outlet port 19 is 2 mm.

On the other hand, the centrifugal fan 1 according to "the embodiment" includes the flanges 14 and the plural protruding streaks 15 as described above. The height of the outlet port 19 is, for example, 4.5 mm.

In "Comparative Example 2," the flanges 14 are formed and a satisfactory advantage of preventing invasion of foreign object is obtained. As illustrated in FIG. 6, comparing "Comparative Example 1" and "Comparative Example 2", since the covered area of each outlet port 19 is larger, "Comparative Example 2" provides relatively larger noise and a reduced static pressure.

The centrifugal fan 1 according to "The embodiment" exhibits a satisfactory advantage of preventing invasion of foreign object. The centrifugal fan 1 exhibits slightly-improved noise and a slightly-reduced static pressure and does not exhibit a large difference in characteristics, in comparison with "Comparative Example 1." That is, in the embodiment, since a part of each outlet port 19 is covered with the flange 14 but air discharged from the impeller 30 passes between the plural protruding streaks 15 and is discharged to the outside of the casing, the static pressure is secured. Since air discharged from the impeller is rectified by passing between the plural protruding streaks 15, noise is suppressed.

In this way, according to the embodiment, it is possible to achieve an advantage of preventing invasion of foreign object without lowering air volume characteristics of the centrifugal fan 1 or performance on a magnitude of noise.

In the centrifugal fan including the flanges 14 but not including the plural protruding streaks 15, the size L in the axial direction of the outlet ports 19 may be set to about 4.5 mm. In this case, in comparison with a case in which the plural protruding streaks 15 are formed, more air discharged from the impeller 30 collides with the flanges 14, characteristics of noise or static pressure are relatively low, but the advantage of preventing invasion of foreign object can be satisfactorily achieved. That is, the plural protruding streaks 15 may not be necessarily formed. In this case, it is possible to achieve the advantage of preventing invasion of foreign object and to make the noise or static pressure characteristic relatively good by setting the size L in the axial direction of the outlet ports 19 to be relatively great.

The shape of the casing is not limited to the substantially square shape in a plan view. The casing may have a polygonal shape or may have an asymmetric shape with respect to the rotation axis. The fastening positions of the upper casing and the lower casing are not limited to the insides of four corners of the upper casing in a plan view. For example, screws or supports for coupling the upper casing and the lower casing may be formed at positions adjacent to the upper casing so as to protrude outward from the outer circumferential edges having a substantially square shape in a plan view of the upper casing.

The shape of the impeller is not limited to the above-mentioned shape. The impeller may have a shape in which lower portions of the blades are connected to the shroud on the lower side and the blades do not directly face the lower casing.

The flanges are not limited to the arched shape in the above-mentioned embodiment. The flanges may be formed to protrude in the outer radial direction of the impeller from the outer circumferential edges of the upper casing and to partially cover the outlet ports when viewed from a side. When the flanges are formed in this way, it is possible to effectively prevent foreign object from coming into contact with the impeller.

The flanges may be formed as members other than the body of the upper casing. That is, the upper casing having the flanges may have a structure in which independently-formed flanges are attached to the body of the upper casing.

The protruding streaks are not limited to the above-mentioned number and shape. In each flange, ten or more protruding streaks may be formed and eight or less protruding streaks may be formed. The arrangement of the protruding streaks is not limited to the above-mentioned arrangement. Some of the plural protruding streaks may have the same shape and the directions of the protruding streaks may be slightly different from the above-mentioned directions.

It should be understood that the above-mentioned embodiment is exemplary in terms of all points of view but is not restrictive. The scope of the invention is defined by the appended claims, not by the above description, and includes all modifications within a meaning and a scope of the claims.

According to the present invention, the outlet ports are partially covered with the flange protruding in an outward radial direction of the impeller from the outer circumferential edge of the upper casing. Accordingly, it is possible to provide a centrifugal fan having a low possibility that rotation of the impeller will be hindered.

What is claimed is:

1. A centrifugal fan comprising:

an impeller;

an upper casing that is disposed above the impeller;

a lower casing that is disposed below the impeller;

an outlet port that is provided between the upper casing and the lower casing and from which an air suctioned by rotation of the impeller is discharged, wherein the upper casing is provided with a flange that protrudes in an outer radial direction of the impeller from an outer circumferential edge of the upper casing, wherein the flange partially covers the outlet port when viewed from a direction perpendicular to a rotation axis of the impeller, and wherein the flange is provided with a plurality of protruding streaks that protrude in a direction along the rotation axis of the impeller from a surface of the flange facing the lower casing.

2. The centrifugal fan according to claim 1, wherein the flange is formed by integral molding with the upper casing.

3. The centrifugal fan according to claim 1, wherein lengths of the protruding streaks in the radial direction of the impeller are set in accordance with a length of the flange protruding from the outer circumferential edge of the lower casing at positions at which the protruding streaks are provided.

4. The centrifugal fan according to claim 1, wherein the impeller is provided with a hub, a plurality of blades, and an annular shroud, wherein the blades extend in a direction along the rotation axis of the impeller from the annular shroud and is connected to the hub on an inner circumference side of the blades, and wherein the annular shroud is accommodated in a recessed portion that is formed to be concave upward in the upper casing.

5. The centrifugal fan according to claim 1, wherein a length, in a direction along the rotation axis of the impeller, of a part of the outlet port which is not covered with the flange when viewed from the direction perpendicular to the rotation axis is set to be less than 5.6 mm.

6. The centrifugal fan according to claim 1, wherein the lower casing is formed to have a substantially square shape when viewed from a bottom side.

7. The centrifugal fan according to claim 1, wherein the upper casing and the lower casing are attached with each other to configure a combined casing that accommodates the impeller, and wherein the combined casing is formed to have a rectangular parallelepiped shape as a whole except for the flange.

8. The centrifugal fan according to claim 1, wherein the flange has a part extending outward from the upper casing in an arced shape.

9. The centrifugal fan according to claim 1, wherein the flange has a part extending downward and partially covering the outlet port.

10. The centrifugal fan according to claim 1, wherein the flange is formed as a member separated from the upper casing and is attached to the upper casing.

* * * * *